US010384826B2

(12) United States Patent
Atsumi

(10) Patent No.: US 10,384,826 B2
(45) Date of Patent: Aug. 20, 2019

(54) PACKING BOX, PACKING METHOD AND UNPACKING METHOD

(71) Applicant: MITSUBISHI MATERIALS CORPORATION, Tokyo (JP)

(72) Inventor: Tetsuya Atsumi, Suzuka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 431 days.

(21) Appl. No.: 15/206,251

(22) Filed: Jul. 9, 2016

(65) Prior Publication Data

US 2017/0008663 A1 Jan. 12, 2017

(30) Foreign Application Priority Data

Jul. 9, 2015 (JP) ..... 2015-137719

(51) Int. Cl.

| | |
|---|---|
| ***B65D 5/49*** | (2006.01) |
| ***B65D 5/64*** | (2006.01) |
| ***B65B 61/20*** | (2006.01) |
| ***B65B 43/26*** | (2006.01) |
| ***B65B 55/00*** | (2006.01) |
| ***B65B 5/10*** | (2006.01) |

(52) U.S. Cl.

CPC ..... *B65D 5/48038* (2013.01); *B65B 5/10* (2013.01); *B65B 43/265* (2013.01); *B65B 55/00* (2013.01); *B65D 5/64* (2013.01); *B65B 2220/18* (2013.01)

(58) Field of Classification Search

CPC .. B65D 5/48038; B65D 5/48026; B65B 5/10; B65B 2220/18

USPC ..... 229/15; 220/507, 502; 206/499, 505, 206/529, 702

See application file for complete search history.

(56) References Cited

U.S. PATENT DOCUMENTS

| | | | | |
|---|---|---|---|---|
| 7,870,957 | B2 * | 1/2011 | Holley, Jr. | B65D 5/48038 206/427 |
| 2006/0243784 | A1 * | 11/2006 | Glaser | B65D 5/4608 229/117.16 |
| 2007/0251858 | A1 * | 11/2007 | Martinez | B65D 5/48032 206/703 |
| 2009/0056279 | A1 * | 3/2009 | Sasaki | B65D 31/04 53/449 |
| 2009/0101538 | A1 * | 4/2009 | Chen | B65D 5/48026 206/722 |
| 2011/0008585 | A1 * | 1/2011 | Schuelke | B31F 1/2809 428/182 |

FOREIGN PATENT DOCUMENTS

| | | |
|---|---|---|
| JP | 2008-174255 A | 7/2008 |
| JP | 2011-016549 A | 1/2011 |
| JP | 2011-207524 A | 10/2011 |

* cited by examiner

*Primary Examiner* — Robert F Long
*Assistant Examiner* — Xavier A Madison
(74) *Attorney, Agent, or Firm* — Locke Lord LLP

(57) ABSTRACT

A packing box including lattice members which are arranged in a stacked state into stages, a stage-partition plate which is arranged between the stages of the lattice members, two or more inner tubular-trunk frames which are provided in a stacking direction of the lattice members to surround one or more stages of the lattice members, an outer tubular-trunk frame surrounding an outside of two or more stages of the inner tubular-trunk frames, a bottom lid which is arranged under the outer tubular-trunk frame, and a top lid which is arranged on the outer tubular-trunk frame.

20 Claims, 16 Drawing Sheets

PACKING BOX, PACKING METHOD AND UNPACKING METHOD

BACKGROUND OF THE INVENTION

Technical Field

The present invention relates to a packing box, a packing method and an unpacking method in which a packing target is transportation objects such as polycrystalline silicon or the like used as molten material when producing single crystalline silicon.

Priority is claimed on Japanese Patent Application No. 2015-137719, filed Jul. 9, 2015, the content of which is incorporated herein by reference.

Background Art

The Czochralski methods (hereinafter, the "CZ process") is known as one of methods producing single crystalline silicon. The CZ process has an advantage in that single crystalline silicon with large-diameter and high-purity can be easily obtained without dislocation or with very few lattice defects.

In the CZ process, the single crystalline silicon is grown by melting high-purity polycrystalline silicon in a quartz crucible by a heating furnace, bringing seed crystal (i.e., single crystalline silicon) in a suspended state by a wire into contact to the molten silicon, and gradually drawing up it while rotating.

High-purity polycrystalline silicon used for the CZ process is adjusted to pieces having an appropriate size by cutting, cracking or the like from a rod of polycrystalline silicon, then wrapped and packed in order to avoid surface contamination after washing and drying processes; and finally, sent as a package.

In recent years, from the point of view of prevention of global warming, it is required for materials for wrapping or packing objects to be possible to reduce scrapping or incineration, or to reuse. Furthermore, it is required for a packing method to reduce the materials for packing as much as possible, and a packing method which can reduce environmental influence in disposal and working efficiency.

For example, in Patent Document 1, disclosed is a structure for packing objects partitioning an interior of a rectangular trunk by a lattice-like partition, disposing the objects in storage spaces of the objects partitioned by the lattice-like partition, and holding the objects in this state between upper and lower cushionings by elasticity of the upper and lower cushionings. Patent Document 1 describes that, by this structure for packing, it is expected to reduce an amount of the materials for packing and to improve a working efficiency associated with that since pellet-shaped cushioning is not used, and the objects are not individually wrapped. Furthermore by this structure for packing, it is expected to reduce material costs and forming costs since the trunk and the lattice-like partition are made of corrugated papers.

In Patent Document 2, a packing box (a packing means) storing products such as delicate equipment or delicate parts is disclosed. It is described that the packing box is provided with a bottom lid, storage cases, four corner boards disposed at four corners of the bottom lid, pads inserted between the storage cases, a top lid, and a sleeve surrounding them entirely, and it is possible to store far more products in a prescribed space by stacking the storage cases and the pads alternately.

Patent Document 3 discloses that working efficiency can be improved by forming an opening part at a side surface of a returnable box and providing an opening/closing member which can close or open the opening part when the objects are stored into and taken out from the returnable box.

CITATION LIST

[Patent Document 1] Japanese Unexamined Patent Application, First Publication No. 2008-174255

[Patent Document 2] Japanese Unexamined Patent Application, First Publication No. 2011-207524

[Patent Document 3] Japanese Unexamined Patent Application, First Publication No. 2011-16549

SUMMARY OF INVENTION

Technical Problem

However, in the structure for packing by Patent Document 1, even though an effect can be expected as a method of storing objects without damage, there is a problem in that the objects cannot be easily put in since the objects are dropped into the storage spaces for the objects in a state in which the lattice-like partition is inserted in the trunk. Particularly, there is a possibility of deterioration of the working efficiency if the objects are heavy.

In the packing means of Patent Document 2, according to the numbers of objects and stages, there is a merit that many products can be transported if the number of stages is increased, on the other hand, there is a subject that the number of the storage cases is increased so that the number of the storage cases to be disposed is increased after unpacking the products.

In the example of the returnable box of Patent Document 3, as for the working efficiency, it is set to be easy to work. However, since it is set on condition that it is used for many times, it is made of material such as synthetic resin to secure strength and durability, so that there is a subject that a disposal cost or an environmental influence is increased.

The aforesaid package of pieces of high-purity polycrystalline silicon is often packaged at about a several kg to 10 kg per bag, according to kinds of the products. If the package bag is damaged while transporting, polycrystalline silicon is contaminated and the quality thereof is deteriorated. Accordingly, certain strength and durability are required for a transportation box used for transportation. Generally, in order to increase the strength of the transportation box, it is necessary to increase a thickness of material of the transportation box or to use material having strength hard to be destroyed. However, as mentioned above, it leads to increase loads and costs of disposal after use.

Moreover, if the opening part for taking in and out the transportation member and the open/closing member which can close or open are provided on the trunk of Patent Document 1 or a part of the sleeve of Patent Document 2, there is a possibility that the strength of the trunk and the sleeve is deteriorated, so that the quality of the products is in danger of being deteriorated when heavy objects are transported.

The present invention is achieved in consideration of the above circumstances, and has an object to provide a packing box, a packing method, and an unpacking method which is capable of storing transportation objects having substantially the same shape such as packages of pieces of polycrystalline silicon and capable of transporting efficiently without damage even if the transportation object is heavy, with excellent working efficiency in which the transportation objects can be easily taken out from the packing box.

Solution to Problem

A packing box of the present invention includes lattice members which are arranged in a stacked state into stages; a stage-partition plate which is arranged between the stages of the lattice members; two or more inner tubular-trunk frames which are provided in a stacking direction of the lattice members to surround one or more stages of the lattice members; an outer tubular-trunk frame surrounding an outside of two or more stages of the inner tubular-trunk frames; a bottom lid which is arranged under the outer tubular-trunk frame; and a top lid which is arranged on the outer tubular-trunk frame. Note that the "tubular-trunk frame" means a hollow frame body with a closed surrounding wall and upper and lower open ends, including a square tube, a round tube, or the like.

In this packing box, an inner space of the inner tubular-trunk frames is partitioned into a plurality of small spaces by the lattice members and the stage-partition plate, and the transportation objects are each stored in the small spaces respectively, so that the transportation objects can be aligned in the plane direction and the stacking direction. Accordingly, space efficiency can be improved and a plurality of the transportation objects can be efficiently transported.

In this packing box, the respective inner tubular-trunk frames may surround multiple stages of the lattice members.

In this specification, the inner tubular-trunk frames, the lattice members, and the stage-partition plate constructing the packing box are indicated by counting the stages respective for the inner tubular-trunk frames, the lattice members and the stage-partition plate, i.e., counting the stages for the inner tubular-trunk frames, for the lattice members, and for the stage-partition plate.

As described above, in the packing box of the present invention, the outer tubular-trunk frame is provided outside the inner tubular-trunk frames stacked in two or more stages, and a tubular-trunk part of the packing box is constructed as a double structure. Accordingly, before extracting the transportation objects from the small spaces in the inner tubular-trunk frame of the second stage from the top among the inner tubular-trunk frames, whole height of the packing box can be reduced by detaching the outer tubular-trunk frame, the inner tubular-trunk frame of the top stage, and the lattice members and the stage-partition plates surrounded by the inner tubular-trunk frame of the top stage, so that the inner tubular-trunk frames of the lower stages other than the top stage, the lattice members and the stage-partition plates in the part surrounded by the inner tubular-trunk frames of the lower stages are remained.

Before extracting the transportation objects from the small spaces in the inner tubular-trunk frame of the top stage, the inner tubular-trunk frames can be detached in order, after detaching the outer tubular-trunk frame. Before detaching the outer tubular-trunk frame, the transportation objects can be extracted from the inner tubular-trunk frame of the top stage, then detaching the inner tubular-trunk frame of the top stage, the lattice members and the stage-partition plates in the part surrounded by the inner tubular-trunk frame of the top stage. In both cases, the whole height of the packing box can be reduced before extracting the transportation objects from the small spaces in the inner tubular-trunk frame of the second stage from the top among the inner tubular-trunk frames by detaching the outer tubular-trunk frame. Accordingly, the transportation objects stored in the inner tubular-trunk frames of the lower stages can be easily extracted, and the transportation objects can be easily extracted from inside the inner tubular-trunk frames of the lower stages.

The inner tubular-trunk frames and the outer tubular-trunk frame have different tubular shapes from each other, and pack the transportation objects with a double structure, accordingly, packing strength can be maintained enough, and an impact from outside is not easily transmitted to the transportation objects. That is to say, since a certain space is formed between the inner tubular-trunk frames and the outer tubular-trunk frames with the double structure, vibration and the impact of the packing box while transporting can be easily absorbed, the transportation objects can be prevented from breakage. Since the inner tubular-trunk frames and the outer tubular-trunk frame have structures of easy assembling/disassembling, a burden of working can be small. Moreover, it is not necessary to use cushionings or the like, so that an environmental influence can be reduced in a process after using the packing box.

In the packing box of the present invention, it is preferable that the lattice members have a shape of belt plates crossing each other in lengthwise and crosswise, and a projecting length of end parts of the belt plates projecting around the lattice members be shorter than a space between the belt plates.

By forming the projecting length of the end parts of the belt plates shorter than the space between the belt plates, shock absorption spaces formed by small gaps can be formed between an outer periphery of the lattice members (peripheral belt plates) and the inner tubular-trunk frames. In this case in which the shock absorption spaces are provided, since a certain space can be maintained between the inner tubular-trunk frames and the transportation objects, the impact from the outside cannot be easily transmitted to the transportation objects.

On the other hand, if a projecting length of end parts of the belt plates projecting from a periphery of the lattice members is made as the same as a space between the belt plates arranged so as to cross each other, the small spaces dividing whole inner space of the inner tubular-trunk frames can be evenly partitioned.

In the packing box of the present invention, it is preferable that a space between the inner tubular-trunk frames and the outer tubular-trunk frame be 3 mm or larger and 25 mm or smaller.

By providing a certain space between the inner tubular-trunk frames and the outer tubular-trunk frame, the impact by vibration of the transportation objects while transporting can be absorbed. In this case, if the space is smaller than 3 mm, the impact from the outside is easy to directly transmitted to the transportation objects, or if the space is larger than 25 mm, the inner tubular-trunk frames and the outer tubular-trunk frame are easy to be damaged when the impact is applied from the outside, so that impact-absorbing effect is small.

In this packing box of the present invention, it is preferable that the inner tubular-trunk frames be formed of double wall corrugated cardboards in which corrugating mediums are arranged between at least three liners, the corrugating medium arranged at an inner peripheral side of the inner tubular-trunk frame be formed to have a thickness larger than that of the corrugating medium arranged at an outer peripheral side of the inner tubular-trunk frame.

By forming the inner tubular-trunk frames from double wall corrugated cardboard and arranging it so that a side in which the thickness of the corrugating medium (i.e., a flute) of the double wall corrugated cardboard is at an inner peripheral surface side of the inner tubular-trunk frames, breakage reduction effect of the transportation objects can be improved. If the higher packing strength would be necessary, the number of the liners may be increased to four or more.

In the packing box of the present invention, it is preferable that the bottom lid be provided with an overlapping edge part which stands surrounding an outside of an opening-edge part of a lower end part of the outer tubular-trunk frame.

In this packing box, when the transportation objects are packed in the packing box, by arranging the spacers between the overlapping edge part of the bottom lid and the inner tubular-trunk frame of a lowest stage, the inner tubular-trunk frame can be arranged on an accurate position with positioning to the bottom lid, and a space can be maintained between the inner tubular-trunk frame and the overlapping edge part with a size of thickness of the spacers. By detaching the spacers when disposing the outer tubular-trunk frame around the inner tubular-trunk frame, the space between the overlapping edge part of the bottom lid and the inner tubular-trunk frame is formed, so that the outer tubular-trunk frame can be easily inserted into this space. In this case, the transportation objects can be arranged and stacked at substantially a center part with respect to the bottom lid, so that the packing box can be assembled in a stable state. As a result, shifting while transporting can be prevented, and the transportation objects can be reliably protected.

According to the present invention, a packing method which stores transportation objects in a stacked state into multiple stages in the packing box as assembling the packing box, including the steps of forming a plurality of small spaces of a lowest stage by arranging one of the inner tubular-trunk frames on the bottom lid and arranging one of the lattice members in the inner tubular-trunk frame, and after putting the transportation objects into the small spaces of at least the lowest stage, arranging the outer tubular-trunk frame at an outside of the inner tubular-trunk frame.

By arranging the outer tubular-trunk frame at the outside of the inner tubular-trunk frame after putting the transportation objects into the small spaces of the lower stage, the whole height of the packing box can be maintained low when putting the transportation objects into the inner space of the inner tubular-trunk frame of the lower stage, so that the transportation objects can be easily stored in the inner tubular-trunk frame of the lower stage.

Alternately, a packing method of the present invention which stores the transportation objects in a stacked state into multiple stages in the packing box having the overlapping edge part as assembling the packing box, including the steps of forming the plurality of the small spaces of the lowest stage by arranging one of the inner tubular-trunk frames of the lowest stage on the bottom lid and arranging one of the lattice members in the inner tubular-trunk frame, keeping a space between the inner tubular-trunk frame of the lowest stage and the overlapping edge part of the bottom lid by arranging a spacer between the inner tubular frame of the lowest stage and the overlapping edge part of the bottom lid in a state before the outer tubular-trunk frame is arranged, and after putting the transportation objects into the small spaces at least the lowest stage, arranging the outer tubular-trunk frame at an outside of the inner tubular-trunk frame.

When the transportation objects is packed in the packing box, by arranging the spacers between the overlapping edge part of the bottom lid and the inner tubular-trunk frame of the lowest stage, the inner tubular-trunk frame can be arranged at an accurate position with respect to the bottom lid with positioning them, and a space can be maintained between the inner tubular-trunk frame and the overlapping edge part with a size of thickness of the spacers. By detaching the spacers when disposing the outer tubular-trunk frame around the inner tubular-trunk frame, the space between the overlapping edge part and the inner tubular-trunk frame is formed, so that the outer tubular-trunk frame can be easily inserted into this space. In this case, since the packing box can be assembled in a stable state, and the transportation objects can be reliably protected by the inner tubular-trunk frames and the outer tubular-trunk frame.

An unpacking method for unpacking transportation objects from the packing box, the transportation objects stored in a plurality of small spaces formed by partitioning an inner space of the inner tubular-trunk frame of the packing box by the lattice members and the stage-partition plates, in this unpacking method, the outer tubular-trunk frame is removed before the transportation objects are taken out from the small spaces in any of the inner tubular-trunk frames under a top stage.

By detaching the outer tubular-trunk frame before the transportation objects are extracted from the small spaces in the inner tubular-trunk frame of the second stage from the top among the inner tubular-trunk frames, the whole height of the packing box can be reduced. Accordingly, the transportation objects stored in the inner tubular-trunk frames of the lower stages can be easily extracted.

In the present invention, the transportation objects are packages in which polycrystalline silicon is packed.

Advantageous Effects of Invention

According to the present invention, a plurality of transportation objects having substantially the same shape can be stored, it is capable transporting efficiency, and it is easy to extract the transportation objects from the packing box. The packing box of the present invention has enough strength required for a process of transporting heavy objects, in a process of packing material after transporting, a burden of working is small, and the packing material is relatively reduced, so that an influence on the environmental influence can be reduced.

DESCRIPTION OF EMBODIMENTS

Below, embodiments in which the present invention is applied to a packing box for silicon for storing packages of pieces of polycrystalline silicon will be explained referring drawings. Following embodiments are examples of the packing box according to the present invention.

Figure 1:
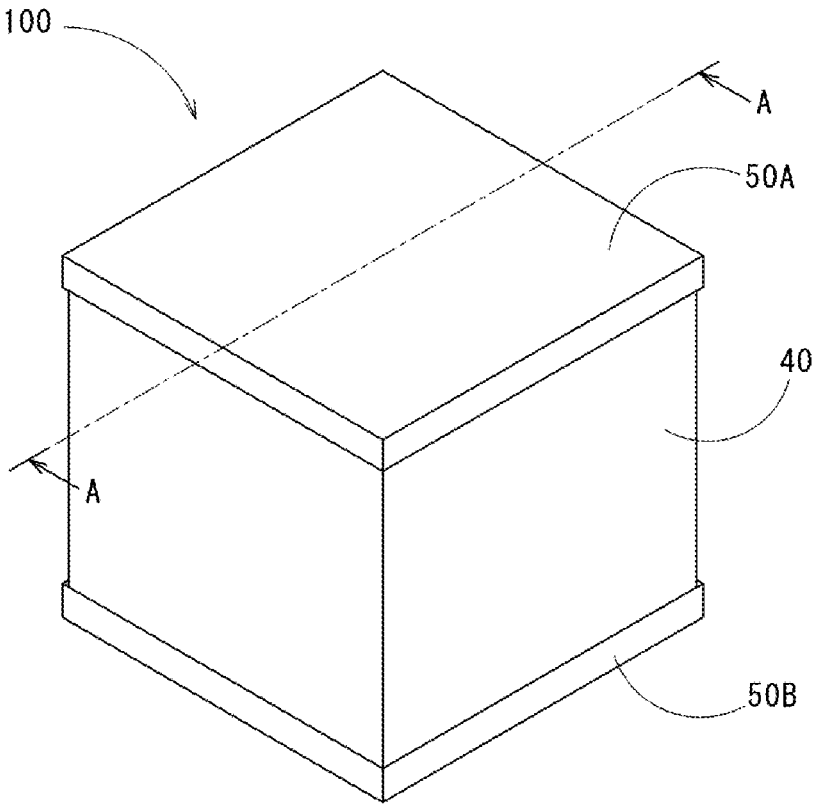
FIG. 1 is a perspective outside view showing a packing box of a first embodiment according to the present invention.
Figure 2:
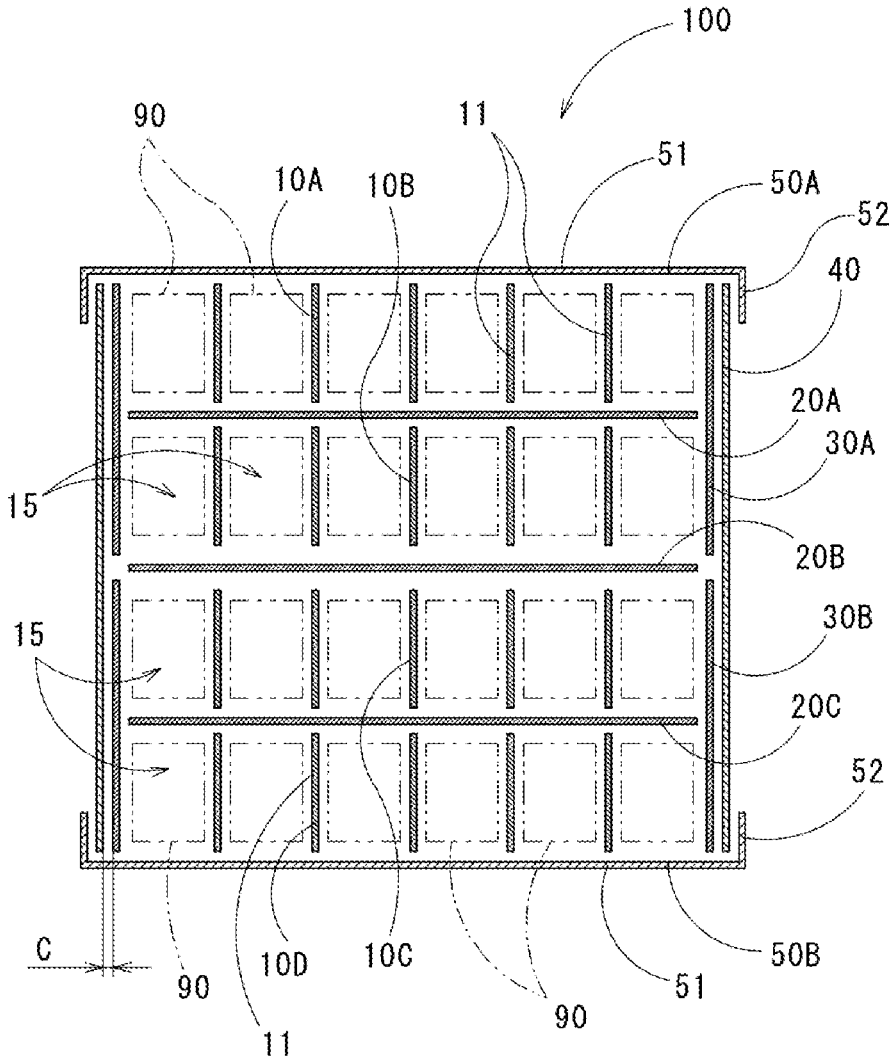
FIG. 2 is a sectional view of the packing box shown in FIG. 1 along the line A-A.
Figure 3:
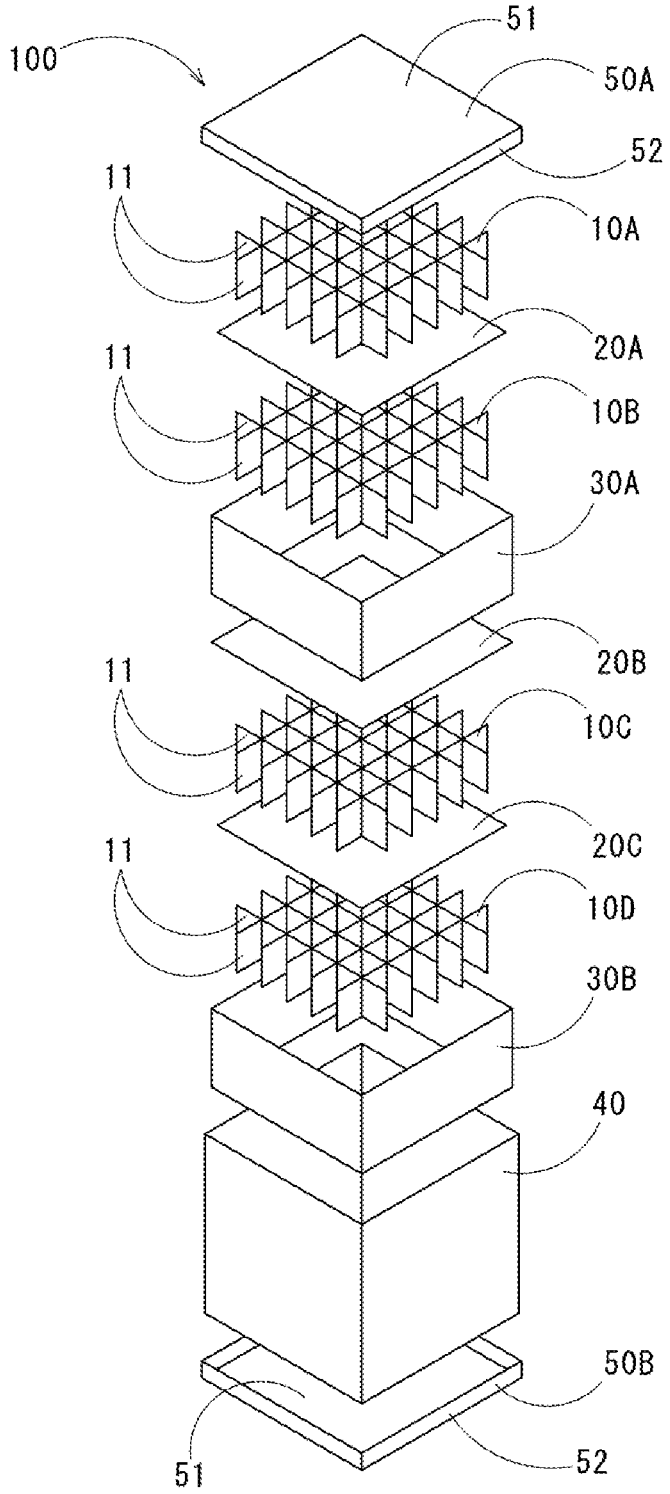
FIG. 3 is an exploded perspective view showing respective parts of the packing box shown in FIG. 1.

FIGS. 1 to 3 show a packing box 100 of a first embodiment of the present invention. The packing box 100 can store packages 90 in which pieces of polycrystalline silicon are stored and can transport these packages 90 together.

The packing box 100 has a rectangular parallelepiped shape as shown in FIG. 1. As shown in FIGS. 2 and 3, the packing box 100 is provided with lattice members 10A to 10D arranged in a stacked state into stages, stage-partition plates 20A to 20C arranged between the stages of the lattice members 10A to 10D, inner tubular-trunk frames 30A and 30B of two stages in a stacking direction of the lattice members 10A to 10D to surround one or more stages of the lattice members 10A to 10D, an outer tubular-trunk frame 40 surrounding an outside of the two stages of the inner tubular-trunk frames 30A and 30B, a bottom lid 50B arranged under the outer tubular-trunk frame 40, and a top lid 50A arranged on the outer tubular-trunk frame 40.

In the illustrated packing box 100, four stages of the lattice members 10A to 10D are provided. In the packing box 100, among the four stages of the lattice members 10A to 10D, upper two stages of the lattice members 10A and 10B are surrounded by the upper inner tubular-trunk frame 30A, and lower two stages of the lattice member 10C and 10D are surrounded by the inner tubular-trunk frame 30B. That is to say, upper and lower two stages of the inner tubular-trunk frames 30A and 30B are provided.

Next, members constructing the packing box 100 will be explained.

Figure 10:
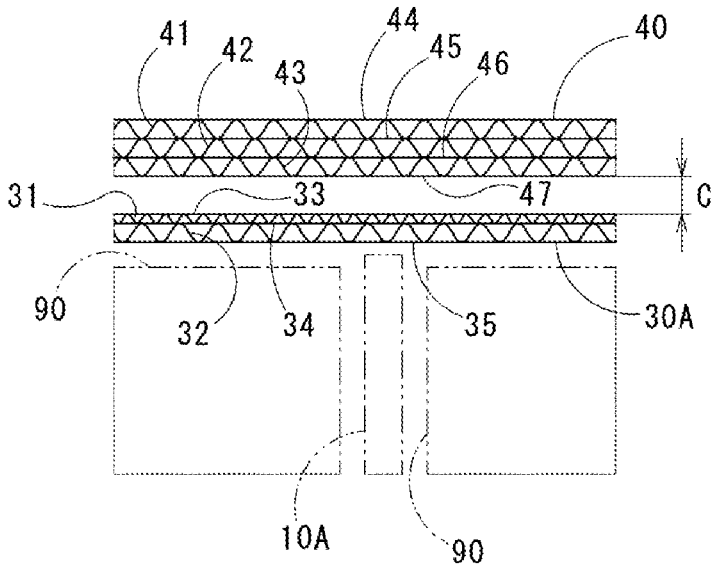
FIG. 10 is a principal part view explaining a relation between the inner tubular-trunk frame and the outer tubular-trunk frame of the packing box.

As shown in FIGS. 2 and 3, the outer tubular-trunk frame 40 is made to have a tubular shape of a rectangular parallelepiped shape with openings at an upper end part and a lower end part from reinforced corrugated paper. For the corrugated paper of the outer tubular-trunk frame 40, double faced corrugated cardboard in which one layer of a corrugating medium formed to have a corrugated shape is arranged between two flat liners, double wall corrugated cardboard or triple-wall corrugated cardboard having two or more layers of corrugating mediums, and the like can be used. Especially, the triple-wall corrugated cardboard is appropriately used, as shown in FIG. 10 for example. The triple-wall corrugated cardboard is formed by arranging three layers of corrugating mediums 41 to 43 formed to have a corrugated shape between four flat liners 44 to 47. The outer tubular-trunk frame 40 has a high strength in a vertical direction by arranging a lengthwise of cavity parts formed between the liners 44 to 47 and the corrugating mediums 41 to 43 along the vertical direction of the outer tubular-trunk frame 40.

The inner tubular-trunk frames 30A and 30B are formed to have a tubular shape of a rectangular parallelepiped shape with openings at an upper end part and a lower end part from corrugated paper (e.g., thickness thereof is about 8 mm), as shown in FIGS. 2 and 3. As the corrugated paper for the inner tubular-trunk frames 30A and 30B, various corrugated papers can be similarly used as for the outer tubular-trunk frame 40, such as double faced corrugated cardboard, double wall corrugated cardboard, or the like. Especially, the double wall corrugated cardboard is appropriately used, as shown in FIG. 10 for example. The double wall corrugated cardboard is formed by arranging two layers of corrugating mediums 31 and 32 formed to have a corrugated shape between three flat liners 33 to 35. In this case, it is preferable that a thickness of the corrugating medium 32 at an inner peripheral side of the inner tubular-trunk frames 30A and 30B by larger than that of the corrugating medium 31 at an outer peripheral side. As this double wall corrugated cardboard, for example, a combination of a corrugating medium having a thickness of about 5 mm and a corrugating medium having a smaller thickness of about 3 mm can be used. Similarly, the inner tubular-trunk frames 30A and 30B has a high strength in a vertical direction by arranging a lengthwise of cavity parts formed between the liners 33 to 35 and the corrugating mediums 31 and 32 along the vertical direction of the inner tubular-trunk frames 30A and 30B, as the outer tubular-trunk frame 40.

As shown in FIG. 2, the inner tubular-trunk frames 30A and 30B have substantially a half height of a height of the outer tubular-trunk frame 40. Accordingly, by arranging the upper and lower two stages of the inner tubular-trunk frames 30A and 30B along a height direction inside the outer tubular-trunk frame 40, a tubular-trunk part of the packing box 100 is constructed as a double structure. A space C between the inner tubular-trunk frames 30A and 30B and the outer tubular-trunk frame 40 is set not smaller than 3 mm and not larger than 25 mm.

The stage-partition plates 20A to 20C are formed from corrugated paper to have a flat plate shape.

The lattice members 10A to 10D is formed from corrugated plastic made from plastic resin such as polypropylene or the like. Alternatively, the lattice members 10A to 10D can be formed from corrugated paper. However, if the lattice members 10A to 10D are made from the corrugated paper, when the transportation objects are heavy, the lattice members may be deformed by vibration while transportation or contact between the transportation objects and the lattice members, and a stability of the transportation objects in small spaces may be deteriorated due to deformation of the lattice members because of moisture absorption. Therefore, in order to reduce damage to the transportation objects, the lattice members 10A to 10D are preferably made from the corrugated plastic.

Figure 4:
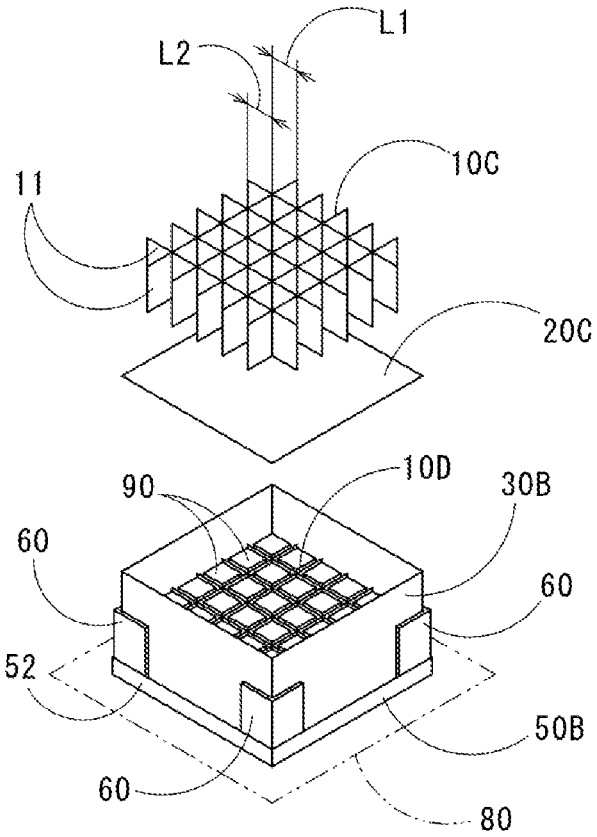
FIG. 4 is a perspective view explaining a middle of an assembling/disassembling process of an inner tubular-trunk frame at a lower stage side of the packing box.

The lattice members 10A to 10D are assembled into a lattice shape by crossing each other belt plates 11 in lengthwise and crosswise for example, as shown in FIG. 3. Specifically, slits are made into each of the belt plates 11 with about half of a height of the belt plates 11, and the belt plates 11 are connected to each other at positions of the slits, so that it is easy to be assembled. The height of the lattice members 10A to 10D (i.e., the belt plates 11) is slightly larger than that of the packages 90 to be stored. The belt plates 11 arranged in the lengthwise and crosswise are arranged at even intervals L1 as shown in FIG. 4. Projection length L2 of end parts of the belt plates 11 projecting from a periphery of the lattice members 10A to 10D are the same as the spaces L1. The spaces between the lattice members 10A to 10D are not limited to be the same length (the space L1) in the lengthwise and crosswise as in this embodiment. Regarding the lattice members, the spaces L1 in the lengthwise and in the crosswise are different from each other, so that it can be open by a rectangular shape. It can be modified in accordance with a shape of the packages to be stored.

By assembling these lattice members 10A to 10D and the stage-partition plates 20A to 20C in an alternate stacking manner, as shown in FIG. 2, an inner space of the inner tubular-trunk frames 30A and 30B is separated into a plurality of small spaces 15 which are aligned in a plane direction and a stacking direction by the lattice members 10A to 10D and the stage-partition plates 20A to 20C.

The top lid 50A and the bottom lid 50B has the same shape, are made from corrugated paper, and symmetrically arranged at a top and bottom as shown in FIGS. 1 to 3. The top lid 50A and the bottom lid 50B have the shape including plane parts 51 and overlapping edge parts 52 which stand surrounding outsides of opening-edge parts of an upper end part and lower end part of the outer tubular-trunk frame 40.

The members constructing the packing box 100 are mainly made from the corrugated paper. As this corrugated paper, the double faced corrugated cardboard, the double wall corrugated cardboard, the triple-wall corrugated cardboard and the like can be appropriately used. The members constructing the packing box 100 are not limited to be made from the corrugated paper, it can be made from other materials.

Next, a packing method of assembling the packing box 100 constructed as above and storing a number of the packages 90 and an unpacking method of unpacking the packages 90 from the packing box 100 storing the packages 90 will be explained.

Figure 8A:
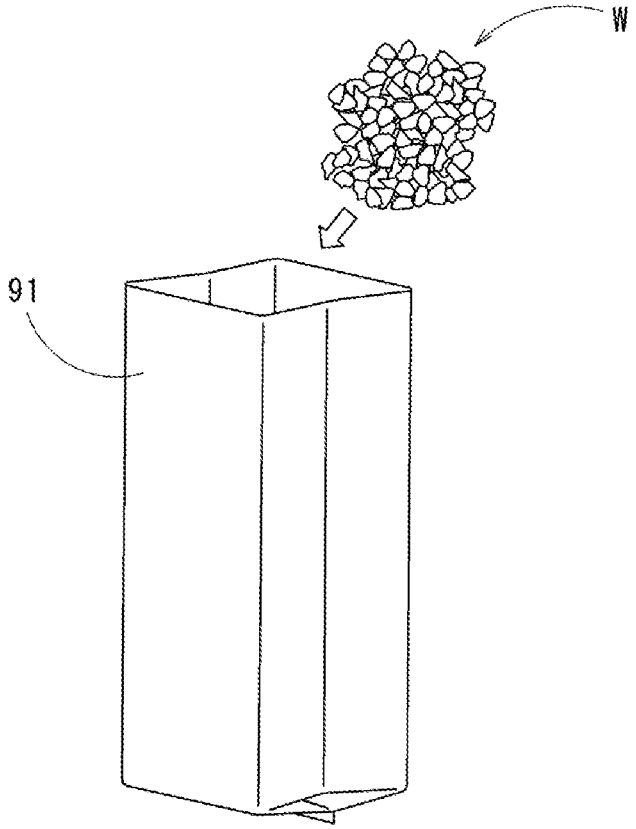
FIGS. 8A and 8B are views explaining a way of forming a package by putting pieces of polycrystalline silicon into a packing bag.
Figure 8B:
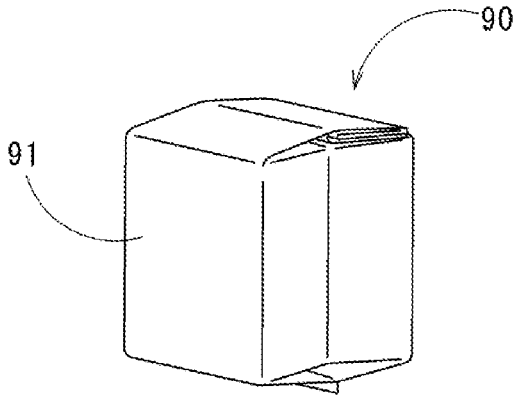

The packages 90 stored in the packing box 100 are, for example, made by storing pieces of polycrystalline silicon W with a maximum side length about 3 mm to 140 mm which are material of single-crystalline silicon in the packing bag 91 by about 5 kg as shown in FIG. 8A, and formed in substantially a cube shape or a rectangular parallelepiped shape as shown in FIG. 8B.

First, as shown in FIG. 4, the bottom lid 50B is placed on a work bench 80. It is possible to construct the work bench 80 by a fixed table which does not move up and down, or an elevating bench which can move up and down. If the work bench 80 is constructed by the elevating bench, it is possible to work with adjusting a height position of the work bench 80 for easy operation of packing or unpacking. Then, after placing the bottom lid 50B on the work bench 80, the inner tubular-trunk frame 30B of the lower stage (the lowest stage) is placed on the bottom lid 50B. At this time, spacers 60 are disposed between the inner tubular-trunk frame 30B of the lower stage and the overlapping edge part 52. In FIG. 4, the spacers 60 have a L-shape and disposed on corners between the inner tubular-trunk frame 30B and the bottom lid 50B, whereas spacers may have a flat-plate shape and be disposed at middle positions of sides. Additionally, the spacers having the L-shape and the spacers having the flat-plate shape can be used together. The spacers 60 are made to have a thickness of 10 mm or more and 40 mm or less. By the spacers 60, the inner tubular-trunk frame 30B is positioned to the bottom lid 50B, and intervals equal to the thickness of the spacers 60 between the inner tubular-trunk frame 30B and the overlapping edge part 52 is maintained.

Next, the lattice member 10D is inserted into the inner space of the inner tubular-trunk frame 30B and disposed on the bottom lid 50B. Subsequently, each of the packages 90 is stored in respective the small spaces 15 partitioned by the lattice member 10D. After storing the packages 90 into the respective small spaces 15 partitioned by the lattice member 10D of the lowest stage, the stage-partition plate 20C is inserted into the inner tubular-trunk frame 30B and placed on the lattice member 10D. Moreover, the lattice member 10C is inserted into the inner tubular-trunk frame 30B so as to be placed on the stage-partition plate 20C, so that the lattice member 10D is stacked on the lattice member 10C with the stage-partition plate 20C therebetween. As a result, a number of the small spaces 15 partitioned by the inner tubular-trunk frame 30B and the lattice member 10C are formed.

Figure 5:
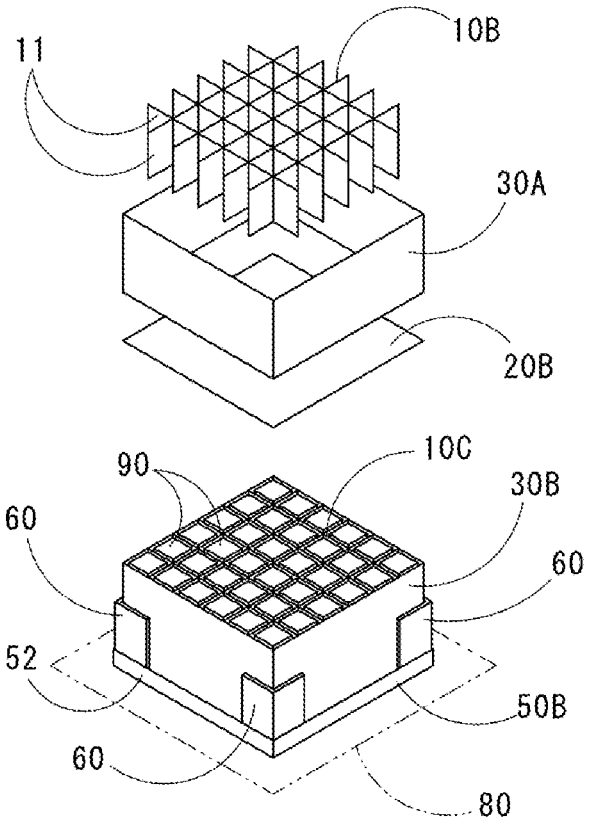
FIG. 5 is a perspective view explaining a middle of an assembling/disassembling process of an inner tubular-trunk frame at an upper stage side of the packing box.

Next, as shown in FIG. 5, after storing the packages 90 into the respective small spaces 15 partitioned by the lattice member 10C of a second stage from the bottom, the inner tubular-trunk frame 30A of an upper stage (a top stage) is placed on the inner tubular-trunk frame 30B of the lower stage. At this time, in order to make a packing operation easy, the height of the work bench may be adjusted. Subsequently, the stage-partition plate 20B is placed on the lattice member 10C. Then, the lattice member 10B is inserted in an inner space of the inner tubular-trunk frame 30A and placed on the stage-partition plate 20B, so that the lattice members 10B to 10D are stacked in three stages.

Figure 6:
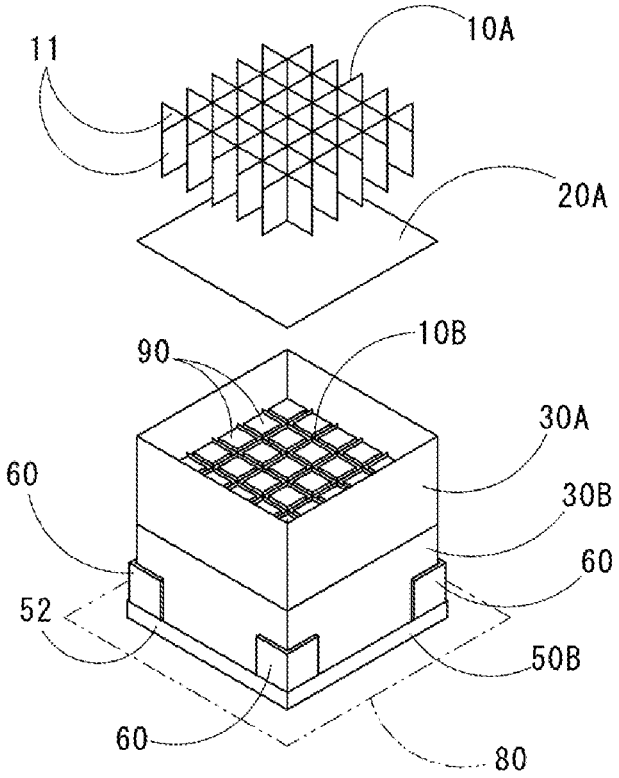
FIG. 6 is a perspective view explaining a middle of an assembling/disassembling process of a lattice member and a stage-partition plate at a top stage of the packing box.
Figure 7:
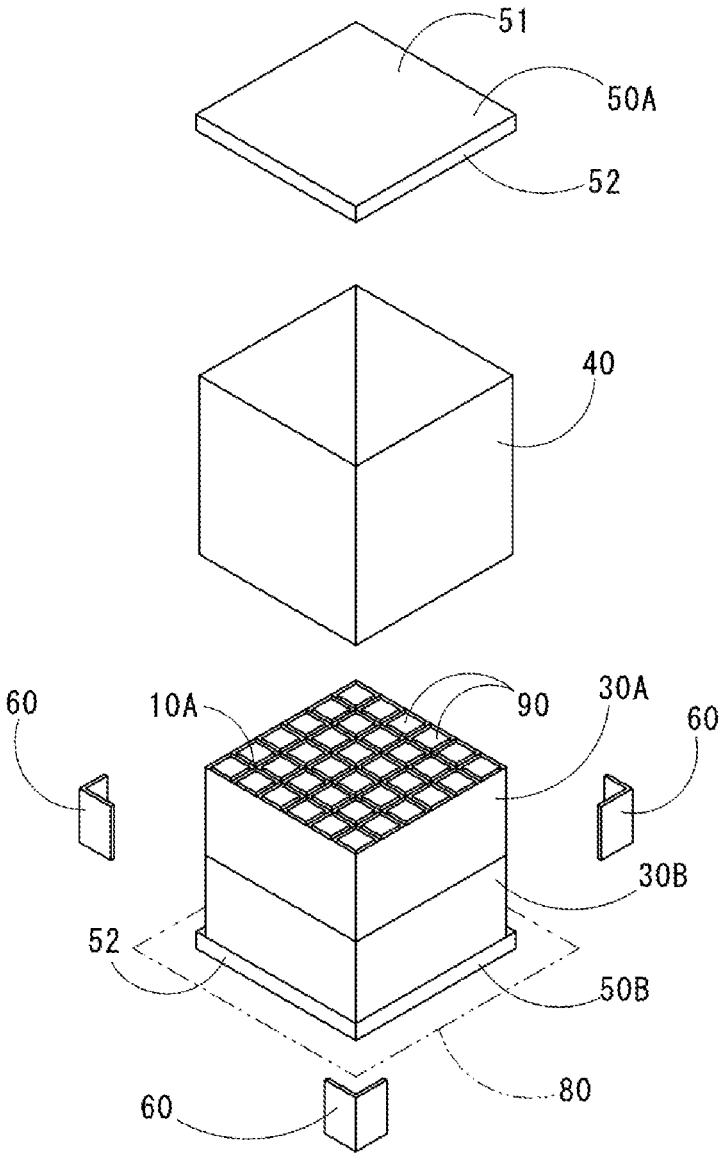
FIG. 7 is a perspective view explaining a middle of an attaching/detaching process of a top lid of the packing box.

Next, as shown in FIG. 6, after storing the packages 90 into the respective small spaces 15 partitioned by the lattice member 10B of a third stage from the bottom, the stage-partition plate 20A is inserted in the inner tubular-trunk frame 30A and placed on the lattice member 10B. Then, the lattice member 10A is placed on the stage-partition plate 20A and inserted in the inner tubular-trunk frame 30A, so that the lattice members 10A to 10D are stacked in four stages. Then, as shown in FIG. 7, after storing the packages 90 in the respective small spaces 15 partitioned by the lattice member 10A of a fourth stage from the bottom, i.e., the top stage, the spacers 60 are detached so as to make the prescribed space between the overlapping edge part 52 of the bottom lid 50B and the inner tubular-trunk frame 30B of the lower stage, and the outer tubular-trunk frame 40 is inserted into the space and placed on the bottom lid 50B, so that the outer tubular-trunk frame 40 surrounds the outside of the inner tubular-trunk frame 30A of the upper stage and the inner tubular-trunk frame 30B of the lower stage. Finally, the packing operation is finished by covering them by the top lid 50A.

Figure 11:
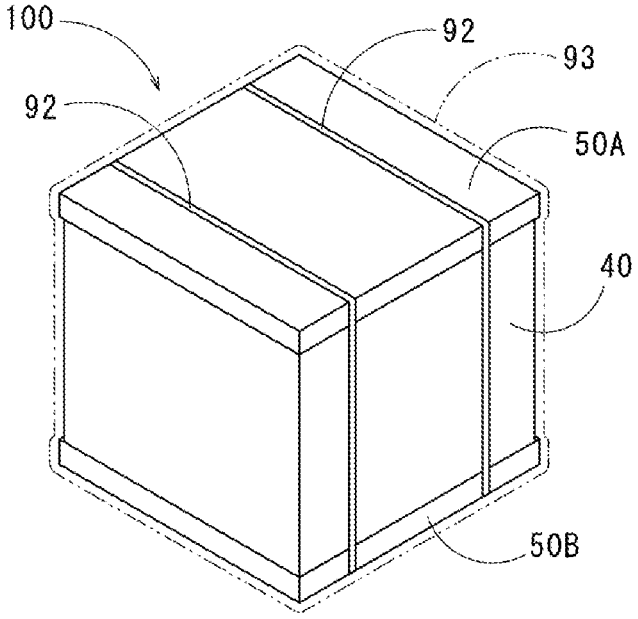
FIG. 11 is a perspective outside view showing the packing box when it is transported.

In addition, the packing box 100 in which the packages 90 are stored is tied with strings 92 or the like in the vertical direction so as to maintain the vertical positions thereof, as shown in FIG. 11 for example, so that the positions of the top lid 50A and the bottom lid 50B are not shifted to the position of the outer tubular-trunk frame 40 in the vertical direction. Furthermore, in order to prevent the packages 90 in the packing box 100 from getting wet or polluting, as shown in FIG. 11 by two-dot chain line, the packing box 100 is transported in a state in which the periphery thereof is wrapped by a vinyl sheet 93 or the like.

Conversely, when the packages 90 are unpacked from the packing box 100, by reverse processes of the processes of the packing method, as shown in FIG. 7, the top lid 50A is detached, and the outer tubular-trunk frame 40 is detached, so that the lattice member 10A of the top stage and the packages 90 stored in the small spaces 15 separated by the lattice member 10A are exposed. Then after extracting the packages 90 from the small spaces 15 partitioned by the lattice member 10A of the top stage, as shown in FIG. 6, the lattice member 10A and the stage-partition plate 20A in the inner tubular-trunk frame 30A are detached, so that the lattice member 10B and the packages 90 in the small spaces 15 partitioned by the lattice member 10B are exposed. After extracting the packages 90 from the small spaces 15 partitioned by the lattice member 10B, as shown in FIG. 5, the lattice member 10B, the inner tubular-trunk frame 30A of the upper stage, and the stage-partition plate 20B are detached. As a result, the inner tubular-trunk frame 30B and the part surrounded by the inner tubular-trunk frame 30B are remained, so that whole height of the packing box 100 can be reduced. In addition, also when the packages 90 are extracted from the packing box 100, by performing the processes on the elevating bench which can move up and down (the work bench 80) as the packing processes, it is possible to work with adjusting the height position for a smooth operation.

Then, after extracting the packages 90 stored in the small spaces 15 partitioned by the lattice member 10C placed in the upper part of the inner tubular-trunk frame 30B, as shown in FIG. 4, the lattice member 10C and the stage-partition plate 20C in the inner tubular-trunk frame 30B are detached, so that the lattice member 10D of the lowest stage and the packages 90 stored in the small spaces 15 partitioned by the lattice member 10D, and the packages 90 are extracted.

In the packing box 100 constructed as above, the inner space of the inner tubular-trunk frames 30A and 30B is partitioned into a number of the small spaces 15 by the lattice members 10A to 10D, and the stage-partition plates 20A to 20C, the packages 90 (the transportation objects) are respectively stored in the small spaces 15, as a result, a number of the packages 90 are arranged in the plane direction and the stacking direction. Accordingly, space efficiency can be improved and a plurality of the packages 90 can be efficiently transported.

The packing box 100 is constructed to have a double structure at the tubular-trunk part by providing the outer tubular-trunk frame 40 outside the inner tubular-trunk frames 30A and 30B which are stacked in two stages. Accordingly, before extracting the packages 90 from the small spaces 15 in the inner tubular-trunk frame 30B of the lower stage side among the inner tubular-trunk frames 30A and 30B of two stages, by detaching the outer tubular-trunk frame 40, the inner tubular-trunk frame 30A of the upper stage, the lattice members 10A and 10B in the part surrounded by the upper inner tubular-trunk frame 30A, and the stage-partition plates 20A and 20B, the inner tubular-trunk frame 30B of the lower stage except the top stage, the lattice members 10C and 10D surrounded by the inner tubular-trunk frame 30B, and the stage-partition plate 20C are remained, so that the whole height of the packing box 100 can be reduced. As a result, the packages 90 stored in the inner tubular-trunk frame 30B of the lower stage can be easily extracted.

Figure 9:
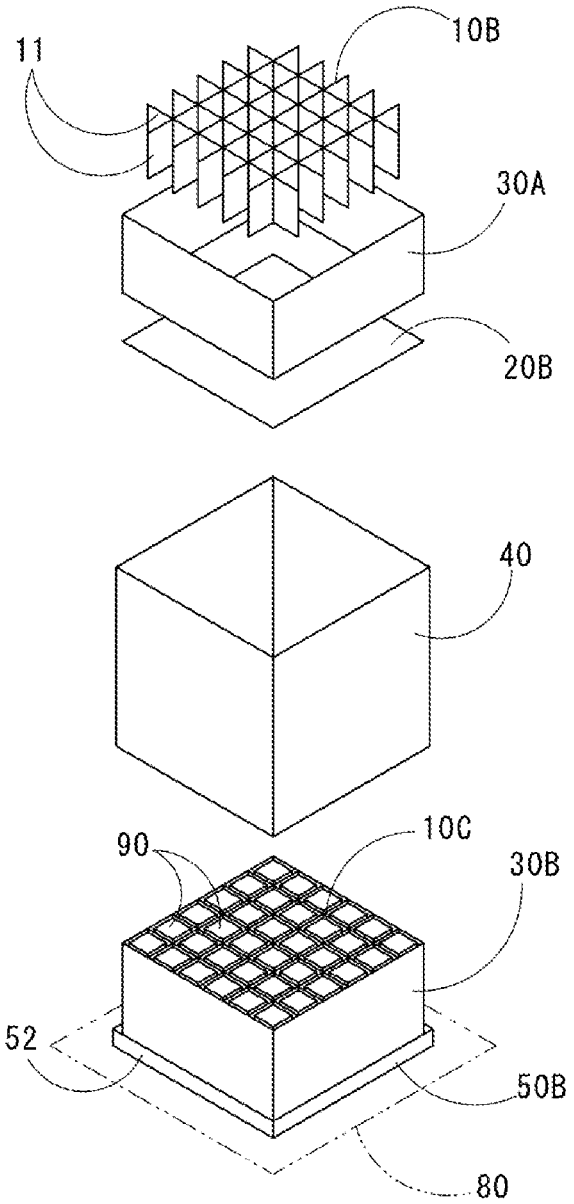
FIG. 9 is a perspective view explaining timing of installing an outer tubular-trunk frame on the packing box.

In the above embodiment, when the packages 90 are packed in the packing box 100, as shown in FIG. 7, after placing the inner tubular-trunk frame 30A of the upper stage on the inner tubular-trunk frame 30B of the lower stage, the outer tubular-trunk frame 40 is arranged outside the inner tubular-trunk frames 30A and 30B so as to surround them. However, timing of arranging the outer tubular-trunk frame 40 is not limited to this. As shown in FIG. 9, after the packages 90 are stored in the small spaces 15 in the inner tubular-trunk frame 30B of the lower stage, the outer tubular-trunk frame 40 may be placed before placing the inner tubular-trunk frame 30A of the upper stage on the inner tubular-trunk frame 30B of the lower stage.

In other words, if the packages 90 are stored at least in the small spaces 15 in the inner tubular-trunk frame 30B of the lower stage among the inner tubular-trunk frames 30A and 30B provided in two stages, the outer tubular-trunk frame 40 may be disposed before the inner tubular-trunk frame 30A is disposed as shown in FIG. 9, or it may be disposed on other timings. In either case, by disposing the outer tubular-trunk frame 40 after the packages 90 are stored in the small spaces 15 in the inner tubular-trunk frame 30B of the lower stage, the whole height of the packing box 100 can be maintained low when the packages 90 are put in the inner space in the inner tubular-trunk frame 30B. Accordingly, the packages 90 can be easily stored in the inner tubular-trunk frame 30B of the lower stage.

Similarly, when the packages 90 are extracted from the packing box 100, the outer tubular-trunk frame 40 may be detached before extracting the packages 90 from the small spaces 15 in the inner tubular-trunk frame 30A of the upper stage of the two stages of the inner tubular-trunk frames 30A and 30B, and then the inner tubular-trunk frames 30A and 30B may be detached sequentially. Before the outer tubular-trunk frame 40 is detached, the packages 90 in the inner tubular-trunk frame 30A of the upper stage may be extracted, and after detaching the inner tubular-trunk frame 30A of the upper stage, the lattice members 10A and 10B in a part surrounded by the inner tubular-trunk frame 30A, and the stage-partition plates 20A and 20B, then the outer tubular-trunk frame 40 may be detached. Timing of detaching the outer tubular-trunk frame 40 is not limited to a case of the above embodiment, if the outer tubular-trunk frame 40 is detached before extracting the packages 90 from the small spaces 15 in the inner tubular-trunk frame 30B of the lower stage of the two stages of the inner tubular-trunk frames 30A and 30B, the inner tubular-trunk frame 30B of the lower stage, the lattice members 10C and 10D in a part surrounded by the inner tubular-trunk frame 30B, and the stage-partition plate 20C are remained, so that whole height of the packing box 100 can be reduced. As a result, the packages 90 stored inside the inner tubular-trunk frame 30B of the lower stage can be easily extracted.

Since the inner tubular-trunk frames 30A and 30B and the outer tubular-trunk frame 40 are constructed to have separated tubular-structures, the packages 90 are packed double by the inner tubular-trunk frames 30A and 30B and the outer tubular-trunk frame 40, so that packing strength can be maintained enough and impact from the outside is not directly transmitted to the packages 90. That is to say, since the certain interval C is provided between the inner tubular-trunk frames 30A and 30B and the outer tubular-trunk frame 40, vibration and the impact by vibration of the packing box 100 while transporting can be easy to absorbed, the packages 90 can be prevented from breakage. If the space C is smaller than 3 mm, the impact from the outside is easy to be directly transmitted, or if the space C is larger than 25 mm, the inner tubular-trunk frames 30A and 30B and the outer tubular-trunk frame 40 are easy to be deformed when the impact is applied from the outside. In both cases, impact-absorbing effect is small. Therefore, the space C is preferably provided with 3 mm or more and 25 mm or less.

Since the inner tubular-trunk frames 30A and 30B and the outer tubular-trunk frame 40 have structures of easy assembling/disassembling, a burden of working can be lighten. Moreover, it is not necessary to use cushionings or the like, so that an environmental influence can be reduced in a process after using the packing box 100.

Furthermore, in the packing box 100, when the packages 90 are packed in the packing box 100, by arranging the spacers 60 between the overlapping edge part 52 of the bottom lid 50B and the inner tubular-trunk frame 30B of the lowest stage, the inner tubular-trunk frame 30B can be arranged on an appropriate position with respect to a surface position of the bottom lid 50B, and a space can be maintained between the inner tubular-trunk frame 30B and the overlapping edge part 52 with a size of thickness of the spacers 60. By detaching the spacers 60 when disposing the outer tubular-trunk frame 40 around the inner tubular-trunk frame 30B, the space between the overlapping edge part 52 of the bottom lid 50B and the inner tubular-trunk frame 30B is formed, so that the outer tubular-trunk frame 40 can be easily inserted into this space at an appropriate position with respect to the surface position of the bottom lid 50B. Accordingly, the members of the packing box 100 and the packages 90 prevent a load from collapsing while transporting, so that the packages can be stably transported.

In the packing box 100 of the above first embodiment, the inner tubular-trunk frames 30A and 30B each surround two stages among the lattice members 10A to 10D, however, it is not limited to this.

Figure 12:
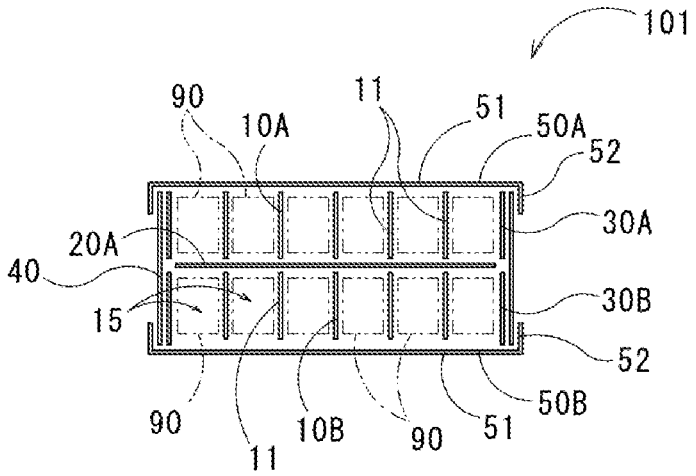
FIG. 12 is a sectional view showing a packing box of a second embodiment according to the present invention, which is an example of a case in which two stages of inner tubular-trunk frames are provided.
Figure 13:
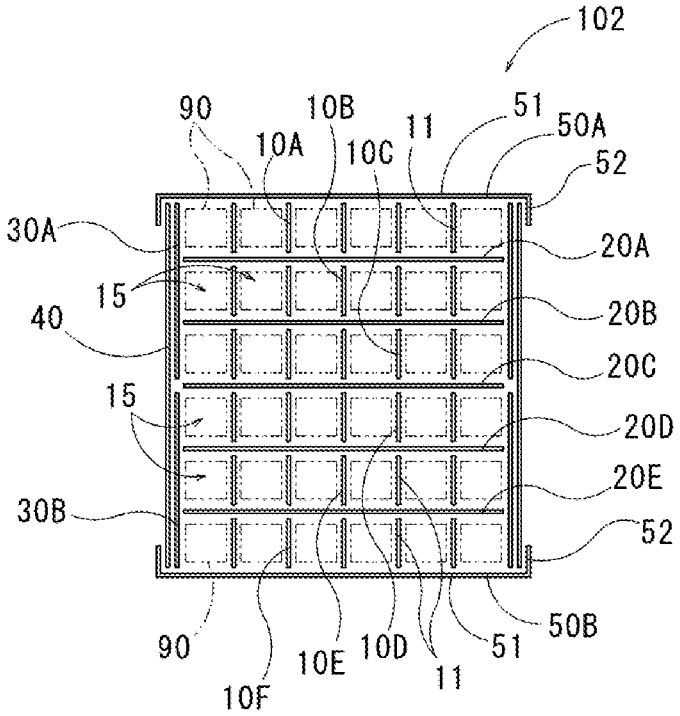
FIG. 13 is a sectional view showing a packing box of a third embodiment according to the present invention, which is an example of a case in which two stages of inner tubular-trunk frames are provided.

For example, as a packing box 101 of a second embodiment shown in FIG. 12 and a packing box 102 of a third embodiment shown in FIG. 13, a structure can be applied as a number of lattice members are provided and parted into halves, and each of the halves is surrounded, not each two pieces of the lattice members. For example, when the lattice members are structured in two stages, as the packing box 101 shown in FIG. 12, the inner tubular-trunk frames 30A and 30B each may surround one stage of the lattice members 10A and 10B. When the lattice members are structured in six stages, as the packing box 102 shown in FIG. 13, the inner tubular-trunk frames 30A and 30B each may surround each three stages of the lattice members 10A to 10C and 10D to 10F.

Figure 14:
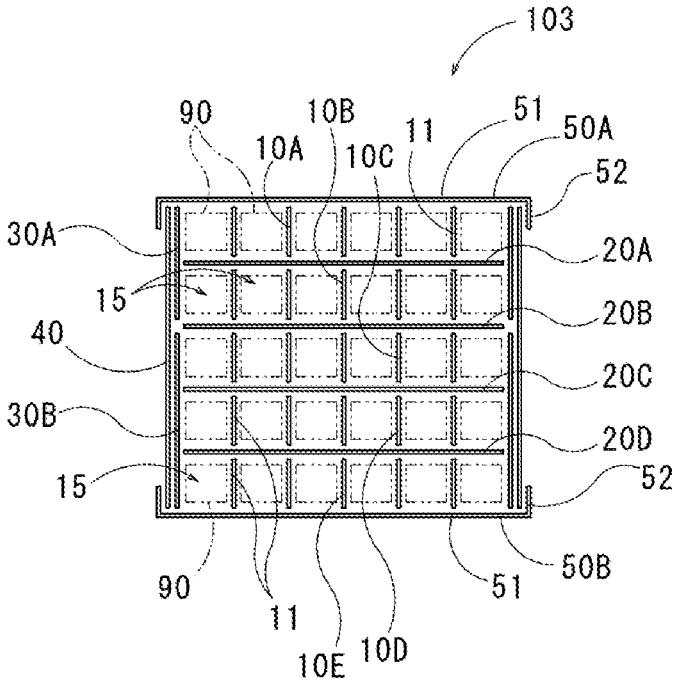
FIG. 14 is a sectional view showing a packing box of a fourth embodiment of the present invention, which is an example of a case in which two stages of inner tubular-trunk frames are provided.
Figure 15:
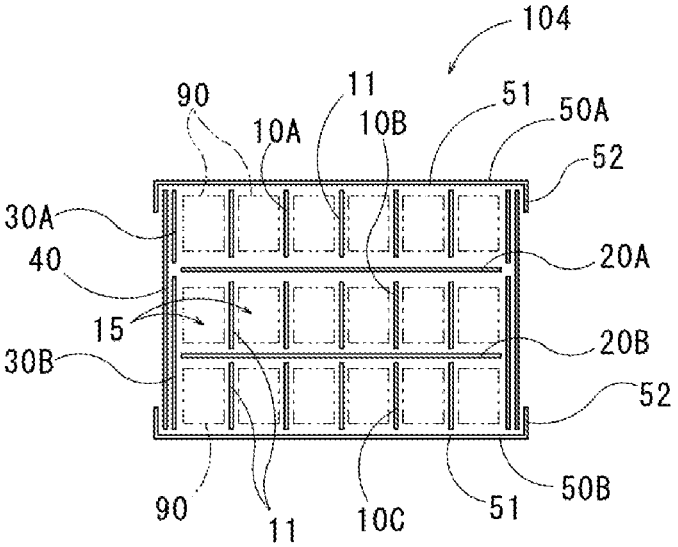
FIG. 15 is a sectional view showing a packing box of a fifth embodiment of the present invention, which is an example of a case in which two stages of inner tubular-trunk frames are provided.

The inner tubular-trunk frame is not limited to the structure of surrounding a half of the lattice members. For example, as a packing box 103 of a fourth embodiment shown in FIG. 14, a structure, assembling the inner tubular-trunk frame 30A of the upper stage surrounding two stages of the lattice member 10A and 10B and the inner tubular-trunk frame 30B of the lower stage surrounding three stages of the lattice members 10C to 10E, can be applied by the two inner tubular-trunk frames 30A and 30B having different heights. Furthermore, as a packing box 104 of a fifth embodiment shown in FIG. 15, it is possible to assemble the inner tubular-trunk frame 30A of an upper stage surrounding the one lattice member 10A and the inner tubular-trunk frame 30B of a lower stage surrounding the two lattice members 10B and 10C.

Figure 16:
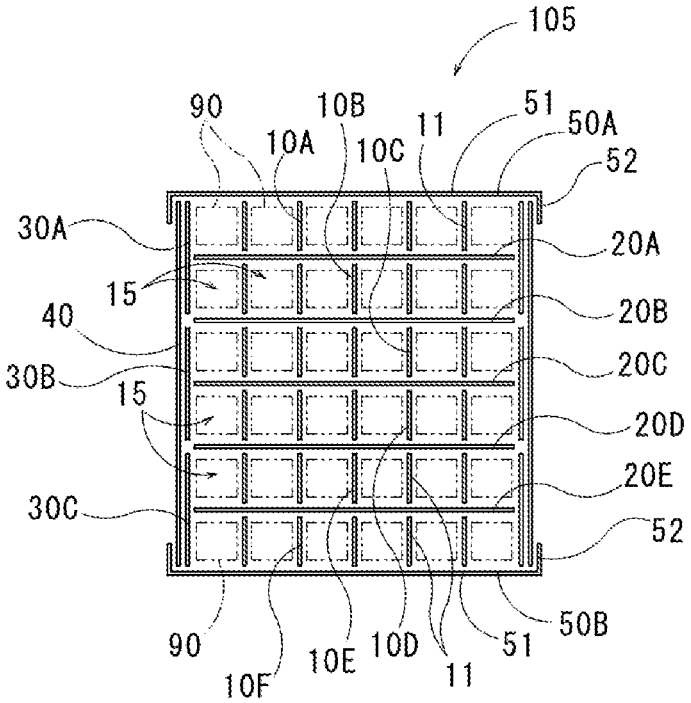
FIG. 16 is a sectional view showing a packing box of a sixth embodiment of the present invention, which is an example of a case in which three stages of inner tubular-trunk frames are provided.
Figure 17:
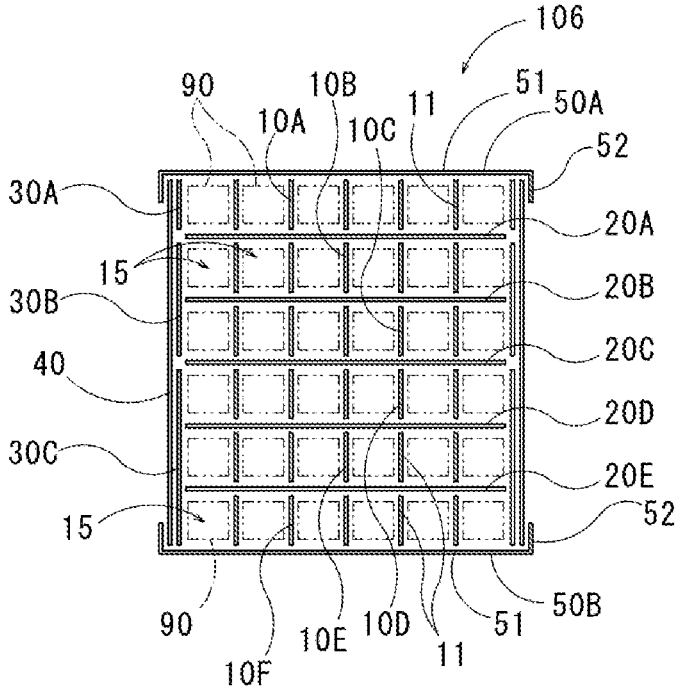
FIG. 17 is a sectional view showing a packing box of a seventh embodiment of the present invention, which is an example of a case in which three stages of inner tubular-trunk frames are provided.
Figure 18:
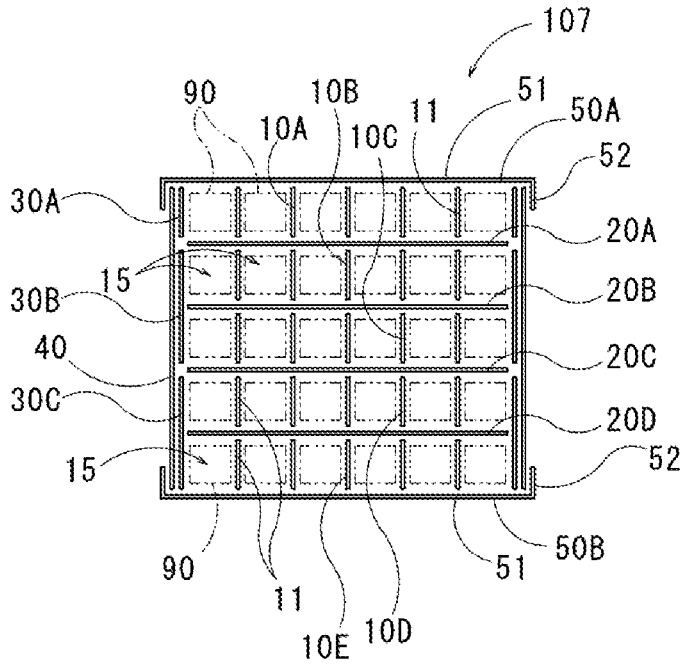
FIG. 18 is a sectional view showing a packing box of an eighth embodiment of the present invention, which is an example of a case in which three stages of inner tubular-trunk frames are provided.

Although the inner tubular-trunk frames 30A and 30B are provided at two stages in the packing box 100 of the above first embodiment, the present invention is not limited to the structure having two stages of the inner tubular-trunk frames. As shown in FIGS. 16 to 18, the three stages or more inner tubular-trunk frames are applicable.

For example, in a case in which the inner tubular-trunk frame is constructed of three stages, as a packing box 105 of a sixth embodiment shown in FIG. 16, the inner tubular-trunk frames 30A to 30C each can be constructed to surround two stages of the lattice members 10A and 10B, 10C and 10D, and 10E and 10F respectively. As a packing box 106 of a seventh embodiment shown in FIG. 17, a structure, assembling the inner tubular-trunk frame 30A of a top stage surrounding one stage of the lattice member 10A, the inner tubular-trunk frame 30B of a middle stage surrounding two stage of the lattice members 10B and 10C, and the inner tubular-trunk frame 30C of a lowest stage surrounding three stages of the lattice members 10D to 10F, can be applied by the three inner tubular-trunk frames 30A to 30C having different heights. A a packing box 107 of an eighth embodiment shown in FIG. 18, it is possible to assemble the inner tubular-trunk frame 30A of an upper stage surrounding one stage of the lattice member 10A and the inner tubular-trunk frames 30B and 30C each surrounding two stages of the lattice members 10B and 10C, and 10D and 10E.

As described above, in the packing boxes 105 to 107 having three stages of the inner tubular-trunk frames 30A to 30C, when packing the packages 90, after storing the packages 90 in the small spaces 15 in the inner tubular-trunk frame 30B of a second stage from the top or in the inner tubular-trunk frame 30C of a third stage from the top among the inner tubular-trunk frames 30A to 30C which are provided in two or more stages, the outer tubular-trunk frame 40 is disposed, as a result, whole height of the packing boxes 105 to 107 can be reduced, and the packages 90 can be easily stored inside the inner tubular-trunk frames 30B and 30C of the lower stages.

Similarly, when the packages 90 are extracted from the packing boxes 105 to 107, detaching the outer tubular-trunk frame 40 before extracting the packages 90 from the small spaces 15 inside the inner tubular-trunk frame 30B of a second stage form the top or inside the inner tubular-trunk frame 30C of a third stage from the top among the inner tubular-trunk frames 30A to 30C which are provided in two or more stages, the inner tubular-trunk frames 30B and 30C of the lower stages and a part surrounded by the inner tubular-trunk frames 30B and 30C are remained, so that whole heights of the packing boxes 105 to 107 can be reduced. As a result, the packages 90 stored inside the inner tubular-trunk frames 30B and the 30C of the lower stages can be easily extracted.

The inner tubular-trunk frame is not limited to the structure of two stages or three stages, three or more stages can be applied.

Figure 19:
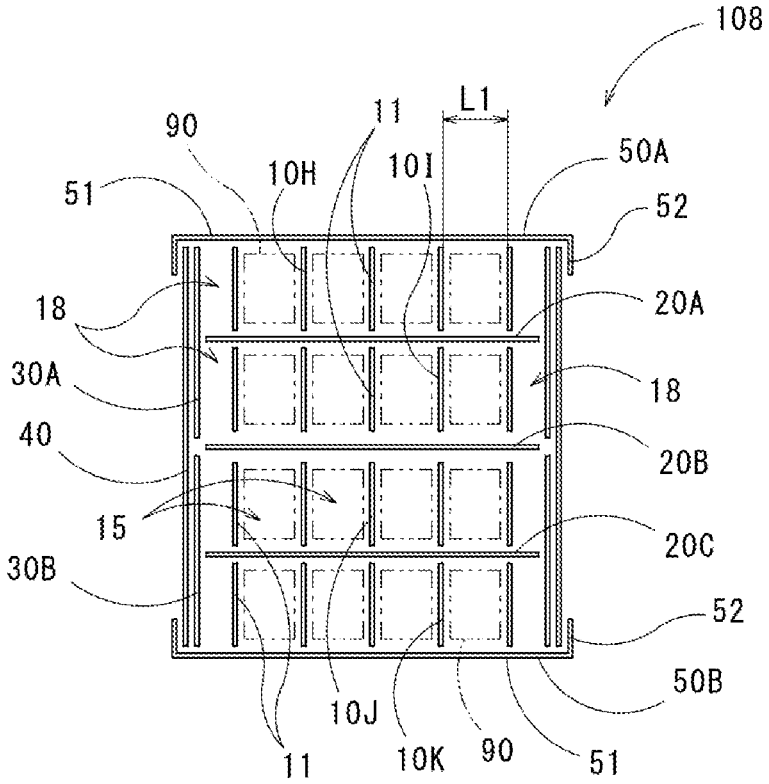
FIG. 19 is a sectional view showing a packing box of a ninth embodiment of the present invention, which is an example of a case in which a shock absorption space is provided.
Figure 20:
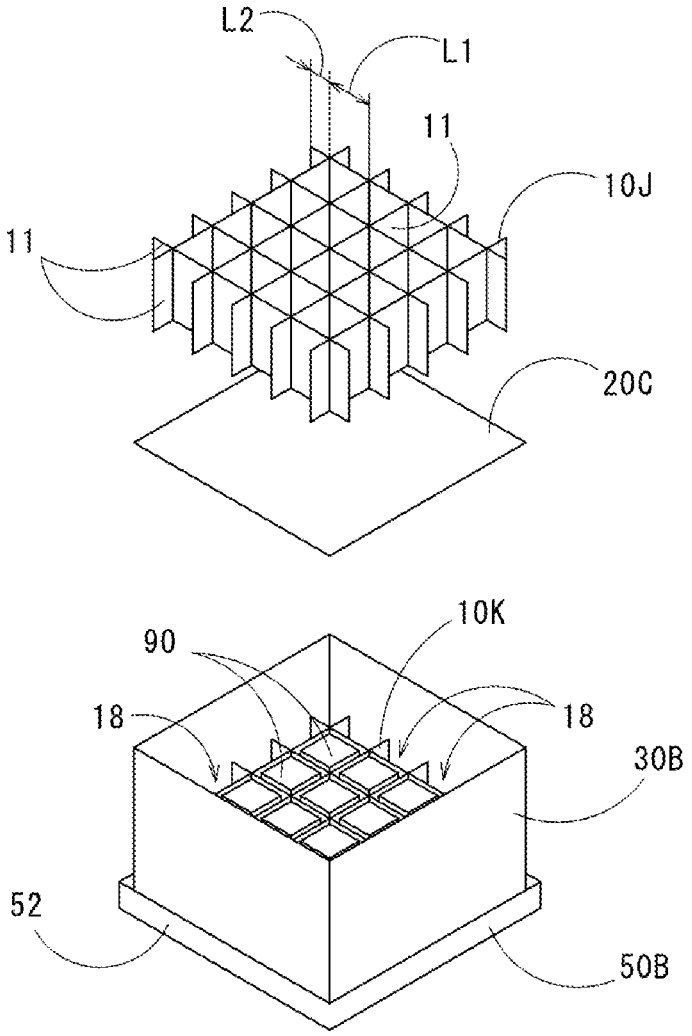
FIG. 20 is a perspective view explaining a middle of an assembling/disassembling process of the packing box shown in FIG. 19.

In the packing boxes 100 to 107 of the above first to eighth embodiments, the projecting length L2 of the end parts of the belt plates 11 projecting from the periphery of the lattice members 10A to 10F are the same as the space L1 between the belt plates 11 arranged so as to cross each other, and the small spaces 15 are partitioned by evenly dividing the inner space of the inner tubular-trunk frames 30A and 30B. However, as a packing box 108 of a ninth embodiment shown in FIGS. 19 and 20, forming the projecting length L2 of the end parts of the belt plates 11 (refer to FIG. 20) shorter than the space L1 between the belt plates 11, shock absorption spaces 18 may be formed between the outer periphery of the lattice members 10H to 10K (the peripheral belt plates) and the inner tubular-trunk frames 30A and 30B. In this case, by forming the shock absorption spaces 18, the certain space can be maintained between the inner tubular-trunk frames 30A and 30B and the packages 90, so that the packages 90 can be prevented from being subjected the impact from the outside.

In the present embodiments, the packages 90 storing the pieces of polycrystalline silicon W was described as an example of packing targets, however, it is not limited to this. For example, rod-shaped objects formed by cutting rod-shaped polycrystalline silicon, packages of single crystalline silicon, or the other objects than silicon member are applicable for packing targets. In this invention, these packing targets including the packages are described as the transportation objects.

REFERENCE SIGNS LIST

10A-10D lattice member
11 belt plate
15 small space
18 shock absorption space
20A-20C stage-partition plate
30A, 30B inner tubular-trunk frame
31, 32, 41, 42, 43 corrugating medium
33, 34, 35, 44, 45, 46, 47 liner
40 outer tubular-trunk frame
50A top lid
50B bottom lid
51 plane part
52 overlapping edge part
60 spacer
80 work bench
90 package (transportation object)
100, 101, 102, 103, 104, 105, 106, 107, 108 packing box

What is claimed is:

1. A packing box comprising:

lattice members which are arranged in a stacked state into stages;

a stage-partition plate which is arranged between the stages of the lattice members;

two or more inner tubular-trunk frames which are provided in a stacking direction of the lattice members to surround one or more stages of the lattice members;

an outer tubular-trunk frame surrounding an outside of two or more stages of the inner tubular-trunk frames;

a bottom lid which is arranged under the outer tubular-trunk frame; and a top lid which is arranged on the outer tubular-trunk frame;

wherein the respective inner tubular-trunk frames surround multiple stages of the lattice members.

2. The packing box according to claim 1, wherein the lattice members have a shape of belt plates crossing each other in lengthwise and crosswise; and a projecting length of an end part of the belt plates projecting around the lattice members is shorter than intervals between the belt plates.

3. The packing box according to claim 1, wherein a space between the inner tubular-trunk frames and the outer tubular-trunk frame is 3 mm or larger and 25 mm or smaller.

4. The packing box according to claim 1, wherein the inner tubular-trunk frames are formed of double wall corrugated cardboards in which corrugating mediums are arranged between at least three liners, the corrugating medium arranged at an inner peripheral side of the inner tubular-trunk frame is formed to have a thickness larger than that of the corrugating medium arranged at an outer peripheral side of the inner tubular-trunk frame.

5. The packing box according to claim 1, wherein the bottom lid is provided with an overlapping edge part which stands surrounding an outside of an opening-edge part of a lower end part of the outer tubular-trunk frame.

6. The packing box according to claim 1, wherein the packing box has a height adjustable to a height of all of stages of lattice members and all stage-partition plates inside; and the lattice members, the stage-partition plate, the inner tubular-trunk frames, the outer tubular-trunk frame, the bottom lid and the top lid are all separate and removable from each other.

7. The packing box according to claim 1, wherein each of the two or more inner tubular-trunk frames has a height equal to a height of a plurality of stages of lattice members and a plurality of stage-partition plates being surrounded therein, the stage-partition plates being flat.

8. The packing box according to claim 1, wherein the outer tubular-trunk frame has a height equal to a height of all of the stages of lattice members and all of the stage-partition plates therein, the stage-partition plates being flat.

9. The packing box according to claim 1, wherein the bottom lid is directly contacting a bottom surface of a lowest stage of lattice members.

10. The packing box according to claim 9, further comprising spacers disposed between the inner tubular-trunk frame surrounding the lowest stage of lattice members and the outer tubular trunk-frame.

11. The packing box according to claim 9, further comprising spacers disposed between the inner tubular-trunk frame surrounding the lowest stage of lattice members and an overlapping edge part of the bottom lid.

12. The packing box according to claim 10, wherein the spacers are members of the group consisting of L-shaped spacers and flat-plate shaped spacers.

13. The packing box according to claim 11, wherein the spacers are members of the group consisting of L-shaped spacers and flat-plate shaped spacers.

14. The packing box according to claim 1, wherein a top lid is directly contacting a top surface of an upper most lattice member.

15. A packing method which stores transportation objects in a stacked state into multiple stages in the packing box according to claim 1 as assembling the packing box, comprising the steps of:

forming a plurality of small spaces of a lowest stage of the lattice members by arranging one of the inner tubular-trunk frames on the bottom lid and arranging one of the lattice members in the inner tubular-trunk frame; and after putting the transportation objects into the small spaces of at least the lowest stage, arranging the outer tubular-trunk frame at an outside of the inner tubular-trunk frame.

16. The packing method according to claim 15, wherein the transportation objects are packages in which polycrystalline silicon is packed.

17. A packing method which stores transportation objects in a stacked state into multiple stages in the packing box according to claim 5 as assembling the packing box, comprising the steps of:

forming a plurality of small spaces of a lowest stage of the lattice members by arranging one of the inner tubular-trunk frames of a lowest stage on the bottom lid and arranging one of the lattice members in the inner tubular-trunk frame;

keeping a space between the inner tubular-trunk frame of the lowest stage and the overlapping edge part of the bottom lid by arranging a spacer between the inner tubular frame of the lowest stage and the overlapping edge part of the bottom lid in a state before the outer tubular-trunk frame is arranged; and after putting the transportation objects into the small spaces at least the lowest stage, arranging the outer tubular-trunk frame at an outside of the inner tubular-trunk frame.

18. The packing method according to claim 17, wherein the transportation objects are packages in which polycrystalline silicon is packed.

19. An unpacking method for unpacking transportation objects from the packing box according to claim 1, the transportation objects stored in a plurality of small spaces formed by partitioning an inner space of the inner tubular-trunk frame of the packing box by the lattice members and the stage-partition plates, wherein the outer tubular-trunk frame is removed before the transportation objects are taken out from the small spaces in any of the inner tubular-trunk frames under a top stage.

20. The unpacking method according to claim 19, wherein the transportation objects are packages in which polycrystalline silicon is packed.

* * * * *